United States Patent [19]

Morais

[11] 4,045,709

[45] Aug. 30, 1977

[54] DISCHARGE LAMP OPERATING CIRCUIT

[75] Inventor: Don Morais, Hendersonville, N.C.

[73] Assignee: General Electric Company, New York, N.Y.

[21] Appl. No.: 692,078

[22] Filed: June 2, 1976

[51] Int. Cl.[2] ..... H05B 41/30

[52] U.S. Cl. ..... 315/205; 315/171; 315/208; 315/246; 315/290

[58] Field of Search ..... 315/171, 176, 200 R, 315/205, 208, 246, 278, 283, 290

[56] References Cited

U.S. PATENT DOCUMENTS

| | | | |
|---|---|---|---|
| 3,780,342 | 12/1973 | Grimshaw et al. | 315/176 X |
| 3,886,405 | 5/1975 | Kubo | 315/246 |
| 3,912,969 | 10/1975 | Nakai et al. | 315/278 |
| 3,919,592 | 11/1975 | Gray | 315/205 X |

*Primary Examiner*—Eugene La Roche
*Attorney, Agent, or Firm*—Sidney Greenberg

[57] ABSTRACT

Increased color temperature of high pressure sodium vapor discharge lamps is provided by improved operating circuit for applying pulsed direct current to the lamp. The circuit includes a direct current ballast circuit having low ripple factor and a pulsing circuit comprising a controlled thyristor switch which operates to apply DC pulses to the lamp at a predetermined repetition rate and duty cycle. The described circuit provides for gradual increase in power applied to the discharge lamp during the starting interval and thereby avoids instability of lamp operation during that stage.

11 Claims, 3 Drawing Figures

DISCHARGE LAMP OPERATING CIRCUIT

The present invention relates to discharge lamp operating circuits, and more particularly concerns a direct operating circuit for such lamps.

It is an object of the invention to provide an improved DC operation circuit for pulsed operation of gaseous discharge lamps, and particularly lamps of high pressure sodium vapor type to produce improved color properties of the lamp light output.

Another object of the invention is to provide a lamp operating circuit of the above type which avoids instability of lamp operation during the starting interval.

Still another object of the invention is to provide a lamp operating circuit of the above type which produces pulses of sufficiently high voltage to ensure continuous operation of the lamp.

A further object of the invention is to provide a starting aid circuit for a lamp operating circuit of the above type.

Other objects and advantages will be come apparent from the following description and the appended claims.

With the above objects in view, the present invention in a preferred embodiment relates to a lamp operating circuit comprising, in combination DC supply means comprising a source of AC current, current limiting reactance means comprising a first induction coil connected to the AC source, an auxiliary induction coil inductively coupled to the first induction coil, first rectifier means connected to the output of the first induction coil, and second rectifier means connected to the output of the auxiliary induction coil, a filter capacitor connected across the first and second rectifier means, and a DC pulsing circuit connected across the filter capacitor comprising a first inductor, unidirectional controlled switch means, and a second capacitor connected in series with each other across the DC supply means, means for serially connecting a gaseous discharge lamp in the DC pulsing circuit, a second inductor of higher inductance than the first inductor connected across the second capacitor and forming a discharge loop therewith, and control means connected to the unidirectional controlled switch means for intermittently operating the same at predetermined intervals, whereby DC pulses are applied to the gaseous discharge lamp for operation thereof and the lamp operation during the starting interval is stabilized.

In a particularly preferred embodiment, the gaseous discharge lamp is of high pressure sodium vapor type, as more fully described below.

The operating circuit of the invention may be used for applying DC pulses of predetermined duty cycle and repetition rate to the lamp for improving the color and other properties thereof. A method and apparatus for pulsed operation of high pressure sodium vapor lamps for improving the color rendition of such lamps are disclosed in co-pending application Ser. No. 649,900 — Osteen, filed Jan. 16, 1976 and assigned to the same assignee as the present invention.

As disclosed in the Osteen application, the high pressure sodium vapor lamp typically has an elongated arc tube containing a filling of xenon at a pressure of about 30 torr as a starting gas and a charge of 25 milligrams of amalgam of 25 weight percent sodium and 75 weight percent mercury.

The present invention provides an improved circuit for DC pulsed operation of such lamps in accordance with the method and principles disclosed in the co-pending Osteen application, and the disclosure thereof in that application is accordingly incorporated herein by reference. As there disclosed, pulses may be applied to the lamp having repetition rates above 500 to about 2,000 Hertz and duty cycles from 10% to 30%. By such operation, the color temperature of the lamp is readily increased and substantial improvement in color rendition is achieved without significant loss in efficacy or reduction in lamp life.

The invention will be better understood from the following description taken in conjunction with the accompanying drawing, in which.

Figure 1:
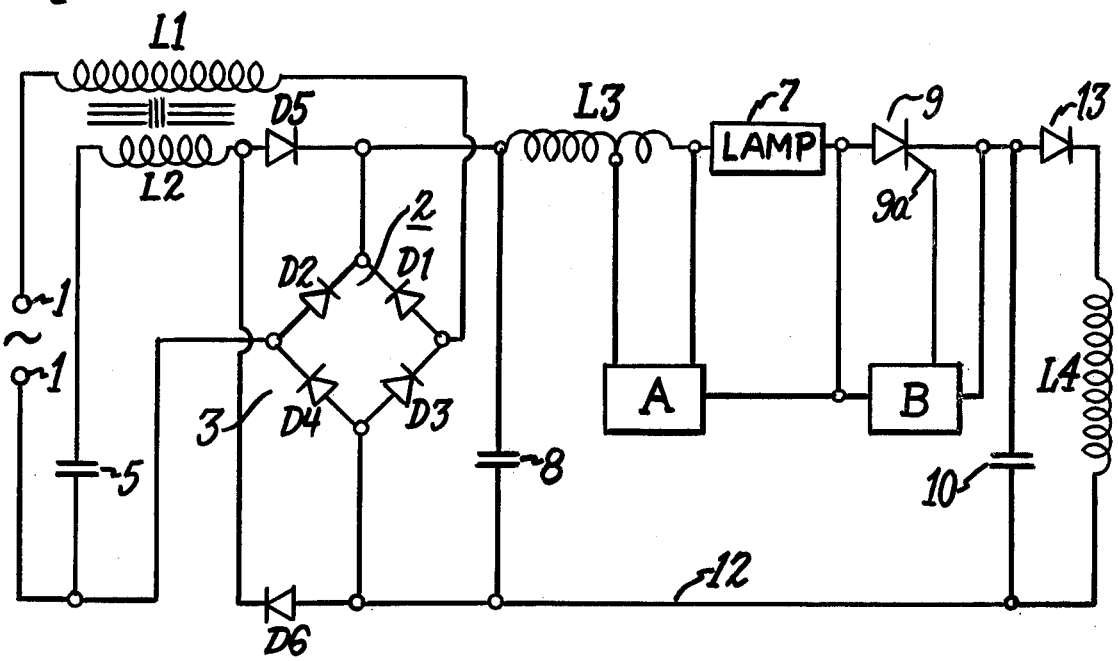
FIG. 1 is a circuit diagram of a DC pulse operating circuit in accordance with a preferred embodiment of the invention.

Referring now to the drawing, and particularly to FIG. 1, there is shown a circuit diagram of a typical embodiment of the invention comprising terminals 1 of a source of alternating current, and induction coil L1 connected at one side to one of the source terminals and at the other side to an input terminal of full wave bridge rectifier 2, which comprises diodes D1, D2, D3 and D4 arranged in conventional manner as shown, the other input terminal of bridge rectifier 2 being connected to the other source terminal 1. Auxiliary induction coil L2 is inductively coupled to main induction coil L1, such as by arrangement of the two coils on a common magnetic core on opposite sides of a magnetic shunt. Such an arrangement of inductively coupled coils is shown, for example, in the patent to Willis, U.S. Pat. No. 3,873,910, issued Mar. 25, 1975 and assigned to the same assignee as the present invention, and the disclosure thereof is accordingly incorporated herein by reference. Auxiliary induction coil L2 is connected at opposite sides respectively to the input terminals of another full wave bridge rectifier 3 constituted by diodes D5 and D6 coacting with diodes D2 and D4 to provide full wave rectification of the current from auxiliary coil L2. Capacitor 5 connected between auxiliary coil L2 and the input terminal of bridge rectifier 3 is selected such that in conjunction with the leakage reactance existing between induction coils L1 and L2, it serves to provide the necessary phase shift and power factor. If induction coil L2 and capacitor 5 are selected so that the portion of the magnetic core associated with coil L2 is saturated, a higher degree of lamp wattage regulation is achieved for a wide range of input voltage.

Connected across the thus described DC supply circuit to the common output terminals of bridge rectifiers 2 and 3 is a lamp pulsing circuit including gaseous discharge lamp 7, particularly of high pressure sodium vapor type, as described above.

By virtue of the described DC supply circuit, the direct current supplied to the lamp by main induction coil L1 via bridge rectifier 2 is substantially out of phase with the direct current supplied to the lamp by auxiliary coil L2 and capacitor 5 via bridge rectifier 3. As a result, the average current through the lamp and the voltage across the lamp is substantially increased over the average magnitude of current and voltage which would be applied in the absence of auxiliary coil L2 and its associated rectifier circuit, and therefore the tendency of the lamp to drop out because of de-ionization at current zero is largely prevented, and at the same time a sufficiently high re-ignition voltage is thereby provided to maintain operation of the lamp. In the operation of the circuit, main induction coil L1 also serves as a current limiting reactance to limit current flowing through the lamp after it starts and thereby provides a ballasting function.

A DC supply circuit of the above described type is disclosed in co-pending application Ser. No. 608,531 — Neal, filed Aug. 28, 1975 and assigned to the same assignee as the present invention, and the disclosure of that application is accordingly incorporated herein by reference.

In the embodiment of the present invention illustrated in FIG. 1, filter capacitor 8 connected across the DC supply circuit provides a filtered DC voltage supply for the pulse generating circuit described hereinafter and increases the average voltage supplied thereto. The type of pulse generating circuit employed in the present invention for pulsed operation of the lamp is disclosed in co-pending application Ser. No. 692,080 — Soileau, filed June 2, 1976, and assigned to the same assignee as the present invention, and the disclosure thereof is accordingly incorporated herein by reference.

It has been found that high intensity gaseous discharge lamps employed in pulsing circuits of the described type are subject to the disadvantage of unstable operation during the starting interval under conditions in which the lamp reaches its operating wattage too rapidly, i.e., without an adequate warm-up period being provide to enable a gradual increase of power to be supplied to the lamp during the starting interval. It has further been found, in accordance with the invention, that the combination of the above-described DC supply circuit with a pulsing circuit of the type disclosed in the aforementioned co-pending Soileau application will provide a relatively slow warm-up period, such that when the lamp reaches its steady state operating wattage, its operation is relatively stable and there is little or no risk of lamp drop-out due to excessive power being applied to the lamp at its start.

As disclosed in the aforementioned co-pending Soileau application, the DC pulsing circuit for lamp 7, which is typically a high pressure sodium vapor lamp such as described above, comprises inductor L3 which is connected between the lamp and the upper terminal of filter capacitor 8. Lamp 7 is connected at its other side to series-connected thyristor switch 9, such as a silicon controlled rectifier (SCR), and capacitor 10 is connected by conductor 12 to the other terminal of filter capacitor 8. Inductor L4 in series with diode 13 is connected across capacitor 10. The operation of SCR 9 is controlled by a timing and triggering circuit B shown in detail in FIG. 3.

The inductance of inductor L4 is substantially higher than that of inductor L3. Typically, the L4 inductance is about 10 times that of L3, but the ratio may be in the range of about 4:1 to about 50:1 or higher. In general, the L4 inductance should be sufficiently high to ensure proper charging of capacitor 10, while the upper limit of its value should be such as to provide for sufficient reversal of the capacitor charge to commutate the SCR switch, as explained below.

Figure 2:
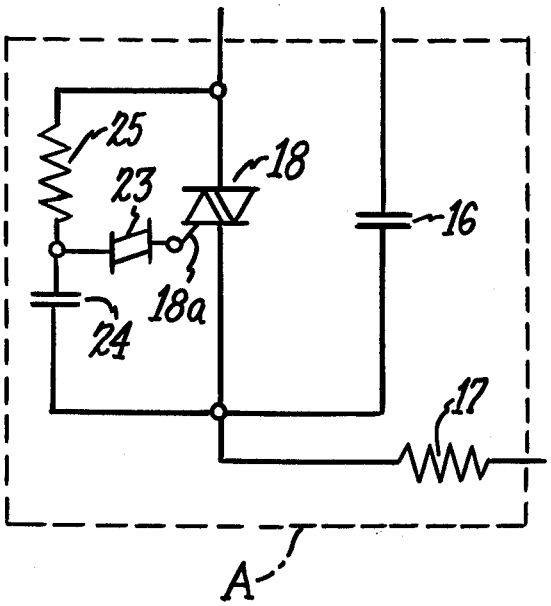
FIG. 2 is a circuit diagram of the lamp starting circuit designated A in FIG. 1.

Lamps of the type described above require relatively high voltage pulses in order to be ignited and thereafter operate on a lower voltage. To this end, starting aid circuit A is connected to inductor L3 and across lamp 7 for applying sufficiently high voltage ignition pulses to the lamp. A suitable circuit for this purpose is shown in FIG. 2 and is of the type disclosed in the patent to Nuckolls, U.S. Pat. No. 3,917,976 issued Nov. 4, 1975 and assigned to the same assignee as the present invention. As seen in FIG. 2, this high voltage pulse generator circuit comprises capacitor 16 and resistor 17 connected in series across lamp 7 and a voltage sensitive symmetrical switch 18, such as a triac, connected between a tap on inductor L3 and the junction of capacitor 16 and resistor 17. Gate electrode **18*a* of the triac is connected to a voltage sensitive triggering device 23 such as the silicon bilateral switch (SBS) shown. The firing of triac 18 is controlled by an RC timing circuit comprising capacitor 24 and resistor 25 connected in series across the triac, with SBS 23 connected to the junction thereof. In the operation of this circuit, capacitor 16 is initially charged by DC current flowing from the DC supply through inductor L3 and the circuit including capacitor 16, resistor 17, the SCR control circuit B, diode 13, and inductor L4 back to the DC supply. Capacitor 24 is charged through inductor L3 and resistor 25 until the voltage across it reaches the breakdown level of SBS 23, at which time triac 18 is triggered on. When this occurs, capacitor 16 discharges through the tapped turns of inductor L3 at its output end, inducing a high voltage, e.g. 3,000 volts, in inductor L3, acting as an autotransformer. Pulses of this high voltage level are produced across lamp 7 by repeated charging and discharging of capacitors 16 and 24 in the described starting circuit until the lamp ignites. Upon starting of the lamp, the described high voltage ignition circuit ceases to operate as a result of the voltage clamping action of the ignited lamp load, and therefore the voltage build up across capacitor 24 does not reach the breakdown level of voltage sensitive switch 23**.

Figure 3:
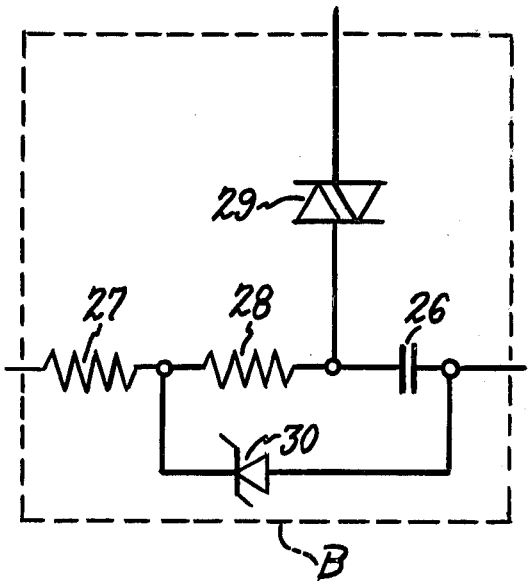
FIG. 3 is a circuit diagram of the switch control circuit designated B in FIG. 1.

As seen in FIG. 3, control circuit B which triggers the operation of SCR switch 9 at predetermined intervals includes an RC timing circuit comprising capacitor 26 and resistors 27 and 28 connected across the SCR switch 9. Voltage breakdown device 29 constituted by a diac is connected at one side to the junction of capacitor 26 and resistor 28 and at the other side to the control (gate) electrode **9*a* of SCR switch 9. Zener diode 30 is connected across capacitor 26 and resistor 28** of the timing circuit.

In the operation of the described pulse operating circuit, when SCR switch 9 is triggered on by the RC timing circuit, DC current flows through inductor L3, lamp 7 and SCR switch 9, thereby charging capacitor 10, which serves as an energy metering device in the circuit. The charge on capacitor 10 reaches a positive voltage substantially higher than the supply voltage, due to the voltage build up thereon as a result of the operation of the LC circuit comprising inductor L3 and capacitor 10. This causes the SCR cathode voltage to be more positive than its anode voltage, achieving commutation, i.e., turn-off, of SCR switch 9. In the absence of the shunt inductor L4, the charge would remain on capacitor 10, thereby preventing subsequent pulsing of lamp 7. In the circuit shown, capacitor 10 discharges and momentarily transfers its energy to inductor L4; subsequently this energy is returned to capacitor 10 but with the polarity of the voltage reversed, such that the upper electrode of capacitor 10 goes to a high negative potential. This negative potential is locked and stored on capacitor 10 by diode 13 and SCR 9. As a result, the voltage across SCR 9 assumed a positive voltage drop from anode to cathode of more than twice the supply voltage. Diode 13 is included in this LC circuit to inhibit oscillations. The next pulse is then provided by operation of the RC timing circuit, which is adjusted to trigger SCR 9 to produce pulses of the desired repetition rate for pulsing lamp 7 in the manner intended.

On subsequent cycles, the positive voltage drop across SCR 9 increases to even higher levels, until an equilibrium potential is reached as a function of the total resistive losses in the circuit. This equilibrium potential can assume values greater than twice the supply voltage. In an illustrative case, the equilibrium voltage across SCR 9 typically reaches about 450 volts during steady state operation. Such higher voltages when imposed across lamp 7 during conduction of SCR 9, serve to ensure re-ionization and continued operation of the lamp, especially when the pulse repetition rate is relatively low.

The operation of the RC timing circuit is such that capacitor 26 is charged at a rate determined by the combination of resistors 27, 28 and capacitor 26. When the potential on capacitor 26 reaches the breakdown voltage of diac 29, capacitor 26 discharges through the loop including SCR control electrode 9*a* and turns on SCR 9. While a diac is shown as the voltage breakdown device 29, other breakdown devices such as silicon bilateral switch (SBS), a Shockley diode, a glow tube, or a series combination of certain of these devices, could be employed.

Zener diode 30 connected to the junction of resistors 27 and 28 of the RC timing circuit stabilizes the frequency of the triggering operation by establishing a fixed clamping voltage toward which capacitor 26 is charged. Resistors 27 and 28 arranged as shown constitute a voltage divider, so that the use of a smaller Zener diode is made possible.

Other details of the described pulse operating circuit and possible modifications thereof are disclosed in the aforementioned co-pending Soileau application.

In a typical circuit, the following components would have the values indicated:

Inductor — 390 turns
Inductor L2 — 468 turns
Capacitor 5 — 7.5 microfarads
Capacitor 8 — 120 microfarads
Inductor L3 — 0.7 millihenries
Inductor L4 — 7 millihenries
Capacitor 10 — 3 microfarads
Capacitor 26 — 0.12 microfarad
Resistor 27 — 41K ohms
Resistor 28 — 7K ohms
Zener diode 30 — 62 volts
Diode 13 — 1K volts
Diac 29 — 38 volts
SCR 9 — 600 volts 25 amps.
Capacitor 16 — 0.1 microfarad
Resistor 17 — 33K ohms
Resistor 25 — 2.2 megohms
Capacitor 24 — 0.12 microfarad
SBS 23 — 9 volts (GE2N4992)
Triac 18 — 400 volts (RCA 40669)

While an SCR is disclosed as the unidirectional controlled switch in the described circuit, it will be understood that other equivalent switch devices may alternatively be employed in accordance with the invention. For example, a triac or a transistor switch may be employed in combination with a diode to provide unidirectional operation, and as used herein the expression "unidirectional controlled switch means" is intended to include all such equivalent switch devices or arrangements.

Further, although the circuit has been described principally in connection with its application to a high pressure sodium vapor lamp, other types of gaseous discharge lamps such as mercury vapor lamps may be employed therewith to obtain the benefits of stabilized operation especially during the starting interval.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What I claim as new and desire to secure by Letters Patent of the United States is:

1. A lamp operating circuit comprising, in combination, DC supply means comprising input terminals for connection to an AC current source, current limiting reactance means comprising a first induction coil connected to said input terminals, an auxiliary induction coil inductively coupled to said first induction coil, first rectifier means connected to the output of said first induction coil, and second rectifier means connected to the output of said auxiliary induction coil, and a DC pulsing circuit connected to said first and second rectifier means and comprising a first inductor, unidirectional controlled switch means, and a capacitor connected in series with each other across said DC supply means, means for serially connecting a gaseous discharge lamp in said DC pulsing circuit, a second inductor of higher inductance than said first inductor connected across said capacitor and forming a discharge loop therewith, and control means connected to said unidirectional controlled switch means for intermittently operating the same at predetermined intervals, whereby DC pulses are applied to the gaseous discharge lamp for operation thereof and operation of the lamp during the starting interval is stabilized.

2. A circuit as defined in claim 1, wherein said capacitor is connected in series with said gaseous discharge lamp connecting means.

3. A circuit as defined in claim 2, wherein a filter capacitor is connected across said DC supply means.

4. A circuit as defined in claim 3, and high voltage lamp starting means including a portion of said first inductor for providing high voltage starting pulses on the gaseous discharge lamp.

5. A circuit as defined in claim 2, and a diode arranged in series with said second inductor across said capacitor.

6. A lamp operating circuit comprising, in combination, DC supply means comprising a source of AC current, current limiting reactance means comprising a first induction coil connected to said AC source, an auxiliary induction coil inductively coupled to said first induction coil, first rectifier means connected to the output of said first induction coil, second rectifier means connected to the output of said auxiliary induction coil, and a first capacitor connected between said auxiliary induction coil and said second rectifier means, and a DC pulsing circuit connected to said DC supply means comprising a first inductor, unidirectional controlled switch means, a second capacitor and a gaseous discharge lamp connected in series with each other across said DC supply means, a second inductor of higher inductance than said first inductor connected across said second capacitor and forming a discharge loop therewith, a diode arranged in series with said second inductor across said second capacitor, and control means connected to said unidirectional controlled switch means for intermittently operating the same at predetermined intervals, whereby DC pulses are applied to said gaseous discharge lamp for operation thereof and operation of said lamp during the starting interval is stabilized.

7. A circuit as defined in claim 6, wherein said gaseous dicharge lamp is a high pressure sodium vapor lamp.

8. A circuit as defined in claim 7, and a filter capacitor connected across said DC supply means.

9. A circuit as defined in claim 8, said first inductor comprising a wound coil having a plurality of turns, said gaseous discharge lamp being connected to the output side of said first inductor, and high voltage lamp starting means including a predetermined number of turns of said wound coil for providing a high voltage starting pulse on said gaseous discharge lamp.

10. A circuit as defined in claim 9, said high voltage lamp starting means comprising a charging capacitor and a resistor connected in series across said gaseous discharge lamp, and voltage sensitive switch means having a predetermined breakdown voltage connected across said charging capacitor and said predetermined number of turns of said wound coil and forming a discharge loop therewith for generating high frequency starting pulses.

11. A circuit as defined in claim 10, said control means comprising an RC timing circuit connected across said unidirectional controlled switch means and being connected in series with said charging capacitor and said resistor.

* * * * *